United States Patent [19]

Evans

[11] 3,999,484

[45] Dec. 28, 1976

[54] DELAY DEVICE HAVING DIMPLED TRANSFER DISC

[75] Inventor: John H. Evans, Lansdale, Pa.

[73] Assignee: ICI United States Inc., Wilmington, Del.

[22] Filed: Oct. 28, 1975

[21] Appl. No.: 626,344

[52] U.S. Cl. ..... 102/28 R; 102/70 R

[51] Int. Cl.[2] ..... F42B 3/16

[58] Field of Search ..... 102/27–29, 102/70

[56] References Cited

UNITED STATES PATENTS

| | | | |
|---|---|---|---|
| 2,103,014 | 12/1937 | Palmieri et al. | 102/28 |
| 2,506,157 | 5/1950 | Loret | 102/28 |
| 3,727,552 | 4/1973 | Zakheim | 102/27 |
| 3,901,259 | 8/1975 | Banbury | 137/68 |
| 3,908,684 | 9/1975 | Short | 137/68 |

*Primary Examiner*—Verlin R. Pendegrass

[57] ABSTRACT

Explosively activated delay device having a squib, a delay charge spaced therefrom, an output explosive charge, and thin metallic transfer disc between the delay charge and the output charge. The improvement in this invention is the provision of a dimpled transfer disc having an inwardly curved central portion in place of a flat transfer disc. A major advantage of the new construction is better heat transfer to the output charge, with consequent greater reliability in firing.

5 Claims, 2 Drawing Figures

DELAY DEVICE HAVING DIMPLED TRANSFER DISC

BACKGROUND OF THE INVENTION

This invention relates to explosively activated delay devices.

Delay devices having an explosively actuated squib having a primary explosive or igniter charge, a delay charge of powdered solid material which is spaced from the igniter charge, and a output charge which is separated from the delay charge by a thin flat disc of heat conductive (usually metallic) material which is secured to the delay device housing, are known in the art. Delay devices of this type are used in various ordnance applications where a delay in firing an output charge is required. A disadvantage of delay devices of this type is that they do not always fire. As the delay charge burns, heat is transmitted through the transfer disc to the output or secondary explosive charge. This heat causes the transfer disc to expand. Pressure inside the delay device housing causes this expansion to be directed outwardly, so that the disc becomes convex on the output side and concave on the delay side. In expanding, the disc separates and loses contact with the burning delay material, or, at, least, contact between disc and delay material is diminished. This results in loss of heat transfer to the output charge. In some cases, this heat transfer loss is sufficient to result in a failure of the output charge to ignite.

SUMMARY OF THE INVENTION

In accordance with the present invention, the flat transfer disc of the previously known delay device described above is replaced with a dimpled transfer disc which is inwardly curved at least in part, having a convex surface in contact with the delay charge and a concave surface in contact with the output charge. The transfer disc preferably also has a flat annular edge portion surrounding a curved central portion. Thus the present device has an ignition charge, a delay charge spaced from the ignition charge, an output charge, and a thin heat conductive transfer disc separating the output charge from the delay charge, and differs from previously known devices in that the transfer disc is curved inwardly as above described. This results in more reliable firing as will be described in more detail hereafter.

DRAWINGS

DESCRIPTION OF THE PREFERRED EMBODIMENT

Figure 2:
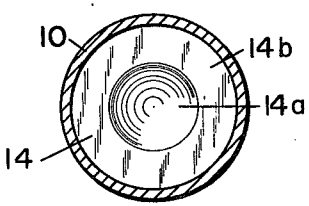
FIG. 2 is a sectional view of the transfer disc in the device of this invention.
Figure 1:
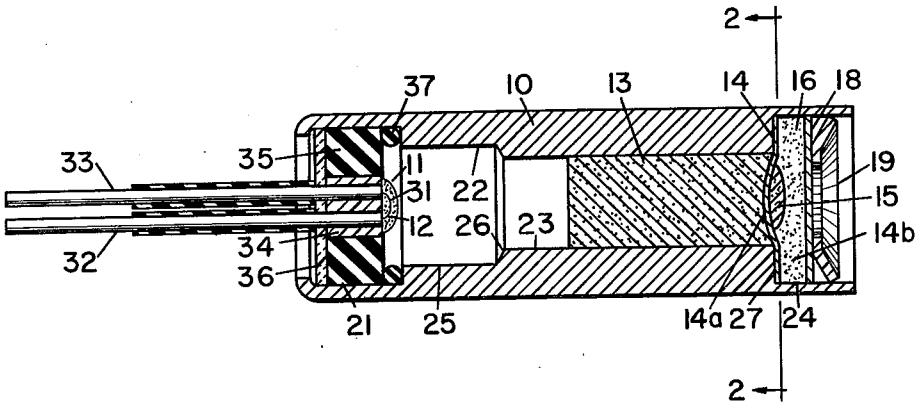
FIG. 1 is a longitudinal midsectional view of the device according to the preferred embodiments of this invention.

Referring now to FIG. 1, 10 is a longitudinally extending housing open at both ends and containing therein a squib 11 that includes a primary ignition charge 12, a powdered delay charge 13 which is spaced from the primary ignition charge 12, a thin heat conductive transfer disc 14 having an inwardly curved central portion 14*a* and a flat edge portion 14*b* surrounding the curved central portion 14*a* and integral therewith, an output charge which includes a coherent ignition component 15 and a mass 16 of powdered explosive material, a closure disc 18, and a disc retaining cup 19. The transfer disc 14 is in contact with the delay charge 13 and the output charge. The output ignition charge 15 is a coherent mass which adheres to the transfer disc 14.

By providing a delay device having a dimpled transfer disc 14 (i.e., a disc having a curved portion 14*a* as shown) instead of a flat disc, a much greater degree of reliability in firing is achieved. A delay device having a structure similar to that shown in FIG. 1, except for a thin flat metallic transfer disc in place of the dimpled disc 14, is known in the art.

The housing 10 is a cylindrical shell, preferably of cylindrical cross section, which is open at both ends and has a bore extending longitudinally therethrough. The housing has a uniform outside diameter. In the preferred embodiment shown, the bore has four portions 21, 22, 23 and 24, numbered in order from the input end to the output end of the device, or different diameters. The two end portions 21 and 24 have the largest internal diameters, and the two intermediate portions 22 and 23 have smaller internal diameters. Housing 10 is correspondingly thinnest at its ends and thicker in the middle. Portions 21 and 22 are joined by shoulder 25. A beveled portion 26 joins portions 22 and 23, the latter being slightly smaller than the former. A second shoulder 27 joins portions 23 and 24. The diameters of the two end portions 21 and 24 can be equal. Also, the bore can have a middle portion of uniform diameter in place of the two intermediate portions 22 and 23 and the beveled portion 26. More broadly, the bore may be of uniform diameter but preferably has at least two portions of different diameters, joined by a shoulder which serves as an abutment for transfer disc 14.

Squib 11, which is situated at one end (the input end) of housing 10, includes an ignition charge 12, a bridge element (e.g., a bridge wire) 31, and a pair of electrical leads 32 and 33 which extend beyond the end of the housing 10. Leads 32 and 33, except for the end portions adjacent to bridge element 31, are preferably insulated. The bridge element 31 joins the ends of leads 32 and 33. The input end of housing 10 is sealed by a pair of concentric cylindrical plugs 34 and 35 and a thin layer of sealing material 36. The inner plug 34 is an insulator, preferably made of glass, and engages bared wire portions of leads 32 and 33, forming a glass-to-metal seal. The outer plug 35 is preferably metallic, e.g., low carbon steel. An O-ring 37 is preferably provided between shoulder 25 and outer plug 35 to assure tight sealing. The end of housing 10 is preferably crimped over sealing layer 36. The ignition plug assembly just described, comprising squib 11 and plugs 34 and 35, is known in the art and details thereof do not constitute part of the present invention.

The delay device of this invention can be initiated mechanically, e.g., by a firing pin and primer charge, instead of electrically via squib 11 as shown, if desired.

The delay charge 13 is a column of finely divided solid material in bore section 23. The delay charge is preferably spaced from the ignition charge 12, but is in contact with the transfer disc 14. The delay charge 13 may be of any column length, composition, particle size, and degree of compaction (which is governed by the pressure used in loading the delay charge into the housing) which will give the desired delay time. For the purpose of this invention, the desired delay time will ordinarily be in the range of about 20 milliseconds to about 30 seconds. The composition of the delay charge does not form a part of the present invention. Suitable delay charge components include zirconium, nickel, barium chromate, and potassium perchlorate. While the delay charge 13 can be adjacent to squib 11, instead of being spaced therefrom as shown, it is greatly preferable to provide space between squib 11 and delay charge 13 so as to provide sufficient volume for the hot gases which are formed in combustion of the delay charge and thereby avoid excessive pressures within the housing.

The transfer disc 14 of this invention is at least in part inwardly curved. The preferred disc is a thin circular metallic article that has a central curved portion 14*a* and a thin flat annular edge portion 14*b* surrounding the central curved portion 14*a*. This curved portion 14*a* has opposed convex and concave surfaces or sides. The convex surface is in contact with the delay charge 13, and the concave surface is in contact with the output charge. The central curved portion is ordinarily in the shape of a segment of a sphere, although the curved shape is not critical. The transfer disc 14 is placed so that the flat annular portion 14*b* thereof is in abutting relationship with shoulder 27, and is secured thereto by conventional means e.g., by brazing metal or alloy which extends around the entire circumference of the shoulder and the disc. The diameter of disc 14 is substantially equal to (i.e., equal to or just slightly smaller than) the diameter of bore section 24, which is the portion of the bore adjacent to disc 14 the concave side. The diameter of the central portion 14*a* of disc 14 is substantially equal to the diameter of bore section 23, which is the portion of the bore adjacent to the transfer disc 14 on the covex side thereof. Since the pressure which disc 14 will withstand is determined in part by the width of the edge portion 14*b*, this edge portion 14*b* and shoulder 27 should be wide enough so that disc 14 will not rupture. The disc 14 is ordinarily quite thin, typically 0.01 inch or less. The disc must be thick enough to withstand the pressure that develops inside housing 10 as the column 13 of delay material burns, but must be thin enough to provide efficient heat transmission to the output ignition charge so that reliable firing will be achieved. According to a specific embodiment of this invention, a disc in which the overall diameter is about 0.22 inch, the diameter of the curved portion 14*a* is 0.128 inch, and the thickness is 0.007 inch, is provided for a delay device of this invention having an outside diameter of 0.25 inch. None of these dimensions is critical; these merely represent the dimensions in a preferred embodiment of this invention.

The entire transfer disc 14 can be inwardly curved if desired, in which case the shoulder 27 is replaced by a beveled surface for supporting the peripheral portion of the disc. While this arrangement permits the disc to be firmly secured to the housing 10, the beveled surface is not as easily fabricated as a flat shoulder 27 as shown. Other modifications of the transfer disc, the housing, or both can be made, provided effective means for securing the disc to the housing are provided.

The output charge preferably comprises two components: (a) an output ignition charge component 15, which is a coherent mass comprising an explosive powder and a binder, and (b) a mass 16 of powdered explosive material, which is generally the major component of the output charge. The ignition component 15 is readily ignited by the heat of combustion of the delay material 15, which is transmitted through transfer disc 14. The ignition component 15 in turn ignites the powdered explosive 16. While a suitable powdered explosive material can be used along as the output charge, the use of an ignition component in conjunction therewith gives more reliable firing. Two-component output charges of this type are known in the art.

The output ignition charge 15 is a coherent mass of explosive material, comprising an explosive powder and a binder, which adheres to the concave side of the transfer disc 14. The explosive powder may be lead styphnate, potassium dinitrobenzofuroxan (KDNBF), lead azide, barium styphnate, a mixture of lead mononitroresorcinate (LMNR) and potassium chlorate, or other explosive. This explosive material may be either the same as or different from the powdered explosive material 16 which constitutes the main portion of the output charge. The binder is a material which is initially liquid but which dries to a solid that will adhere to metal. Nitrocellulose lacquer is a suitable binder; other materials may be used. The mass of the output ignition charge 15 is not critical but must be sufficient to initiate the powdered output charge material 16. The ignition charge 15 is formed by mixing the explosive powder and the binder and applying the mixture to the concave side of the transfer disc 14 while the binder is in the liquid state, and allowing the composition to dry.

The output charge 16 may be of any desired explosive material and in such amount as is required for actuation of the desired explosively actuated device. Lead styphnate is a preferred explosive for this purpose; other explosives which may be used include barium styphnate, lead azide, KDNBF, and a mixture of LMNR and potassium chlorate.

The output end of the device is closed by a flat closure disc 18 and a retainer ring or top 19.

The device of this invention can be used in any service in which a delay between initiation and response is required. For example, this delay device can be used in conjunction with an explosively actuated switch, valve, or high energy explosive. This listing is merely illustrative and is by no means exhaustive. The output charge 16 of this device serves as the actuator or initiator charge for the explosively actuated switch, valve, high explosive charge, or other desired output device.

A major advantage of the device of the present invention is that it is much more reliable in firing than the previously known device having the same structure as that described herein except for a flat transfer disc in place of the dimpled transfer disc 14 herein described. As the delay charge 13 herein burns and heat is transferred from it to the dimpled transfer disc 14, the transfer disc is caused to expand due to heating. Expansion occurs inwardly, so that good contact between the disc 14 and the burning delay material 13 is maintained. The transfer disc therefore is rapidly heated, and heat is efficiently transmitted to the output igniter charge 15 and the output charge 16. In this way reliable firing of the output charge with only a minimal number of failures is assured.

What is claimed is:

1. In an explosive actuated delay device comprising a housing having therein a primary ignition charge, a delay charge, an output charge, a thin heat conductive transfer disc separating said output charge from said delay charge, and means for securing said transfer disc to said housing, the improvement wherein said transfer disc is at least in part inwardly curved, said disc having a convex surface in contact with said delay charge and a concave surface in contact with said output charge.

2. A device according to claim 1 in which said disc has an inwardly curved central portion and a flat annular edge portion surrounding said central portion.

3. A device according to claim 2 in which said housing is cylindrical and of circular cross section and has a bore extending longitudinally therethrough, and in which said disc and the curved central portion thereof are both circular.

4. A device according to claim 3 in which the diameter of the central curved portion of said transfer disc is essentially equal to the diameter of the portion of the bore adjacent to said transfer disc on the convex side thereof.

5. A device according to claim 4 in which the flat annular edge portion of said transfer disc is in abutting relationship with a shoulder in said housing.

* * * * *